US007036479B2

(12) United States Patent
Takenaka et al.

(10) Patent No.: US 7,036,479 B2
(45) Date of Patent: May 2, 2006

(54) CYLINDER BLOCK FOR ENGINE

(75) Inventors: Kazunari Takenaka, Toyota (JP); Seiji Omura, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/077,075

(22) Filed: Mar. 11, 2005

(65) Prior Publication Data

US 2005/0217628 A1 Oct. 6, 2005

(30) Foreign Application Priority Data

Mar. 31, 2004 (JP) ..... 2004-107224

(51) Int. Cl.
*F02F 7/00* (2006.01)

(52) U.S. Cl. ..... 123/193.2; 123/195 R

(58) Field of Classification Search ..... 123/195 R, 123/195 H, 196 CP, 196 R, 193.2
See application file for complete search history.

(56) References Cited

U.S. PATENT DOCUMENTS 6,244,238 B1 * 6/2001 Takahashi et al. ..... 123/195 R

FOREIGN PATENT DOCUMENTS

| | | |
|---|---|---|
| EP | 1288477 A2 * | 3/2003 |
| JP | 2000-136752 | 5/2000 |
| JP | 2001-241356 | 9/2001 |
| JP | 2002-180900 | 6/2002 |
| JP | 2003-074408 | 3/2003 |

* cited by examiner

*Primary Examiner*—Henry C. Yuen
*Assistant Examiner*—Hyder Ali
(74) *Attorney, Agent, or Firm*—Kenyon & Kenyon LLP

(57) ABSTRACT

A cylinder block for an engine has a cylinder assembly having a plurality of cylinders, each corresponding to one of a plurality of pistons. A block body has an outer wall accommodating the cylinder assembly, a crankcase accommodating the crankshaft, and a plurality of partitions. The partitions divide the space in the crankcase into a plurality of crank chambers. The number of the crank chambers corresponds to the number of the cylinders. The outer wall, the crankcase, and the partitions are formed integrally. A partition through portion is formed in a predetermined one of the partitions to connect an adjacent pair of the crank chambers. The partition through portion opens toward the cylinders.

13 Claims, 8 Drawing Sheets

CYLINDER BLOCK FOR ENGINE

BACKGROUND OF THE INVENTION

The present invention relates to a cylinder block for an engine having at least one crank chamber, which cylinder block has a structure for suppressing pressure fluctuation in the crank chamber, thereby reducing pumping loss.

During the operation of an engine, reciprocation of pistons fluctuates the pressure in the crank chamber and the interior of the cylinders, which communicate with the crank chamber. Accordingly, pumping loss occurs.

Conventionally, to reduce pumping loss, a technique has been proposed in which adjacent crank chambers are connected with each other in a crankcase.

Patent documents disclosing such a technique include Japanese Laid-Open Patent Publications No. 2000-136752, No. 2002-180900, No. 2003-74408, No. 2001-241356.

(1) Patent Document 1: Japanese Laid-Open Patent Publication No. 2000-136752 proposes a cylinder block in which through holes are formed in partitions, and the centers of the through holes in the partitions are not aligned.

(2) Patent Document 2: Japanese Laid-Open Patent Publication No. 2002-180900 discloses a technique for connecting adjacent cylinders by forming through holes in partitions, while biasing the through holes relative to the cylinder axes.

(3) Patent Document 3: Japanese Laid-Open Patent Publication No. 2003-74408 discloses a technique for forming a through hole in a cylinder block, which through hole has an axis parallel to the axis of a crankshaft, wherein part of the through hole opens to the inner surface of the cylinder bores.

(4) Patent Document 4: Japanese Laid-Open Patent Publication No. 2001-241356 discloses a technique for forming a through hole extending along an arrangement direction of cylinders, wherein the through hole is inside a wall that is located in a rear section of a cylinder block with respect to the fore-and-aft direction of the vehicle, and the through hole is connected with the crank chamber.

If adjacent crank chambers in a cylinder block are connected with each other, air that is pushed toward one of the crank chambers as the corresponding piston moves flows to the adjacent crank chamber, which suppresses pressure fluctuation in the crank chambers. Accordingly, the pumping loss is reduced.

If adjacent crank chambers in a cylinder block are connected to each other as in the above shown Patent Documents 1 to 3, the structural constraint only allows the through hole to be machined from the outside of the crankcase. Thus, when forming the through hole in a partition, an unnecessary hole that does not contribute to reduce pumping loss is formed in an outer wall of the crankcase.

Since combustion pressure acting on a crankshaft causes stress to be concentrated on areas about through holes, forming of unnecessary through holes as described above is best to be avoided. However, conventional cylinder blocks have no measures for such unnecessary holes.

On the other hand, with recent demands for engines of higher power and better fuel economy, a structure of through holes that effectively reduces pressure fluctuation (pumping loss) has been desired.

However, since the cylinder block disclosed in Patent Document 4 has a structure in which a through hole formed in an outer portion of the wall surrounding the cylinders is connected to the crank chamber through a connector passage, it is possible that, when each piston is reciprocated and pushes air in a section of the cylinder adjacent to the corresponding crank chamber, the air is not smoothly discharged to another crank chamber. In such a case, pressure fluctuation is not sufficiently reduced.

SUMMARY OF THE INVENTION

Accordingly, it is an objective of the present invention to provide a cylinder block having a structure that eliminates the necessity of forming unnecessary through holes in a crankcase, and a structure that efficiently reduces pressure fluctuations in crank chambers.

To achieve the foregoing and other objectives and in accordance with the purpose of the present invention, a cylinder block for an engine having a plurality of pistons and a crankshaft is provided. The cylinder block includes a cylinder assembly, a block body, and a partition through portion. The cylinder assembly has a plurality of cylinders, each corresponding to one of the pistons. The block body has an outer wall accommodating the cylinder assembly, a crankcase accommodating the crankshaft, and a plurality of partitions. The partitions divide the space in the crankcase into a plurality of crank chambers. The number of the crank chambers corresponds to the number of the cylinders. The outer wall, the crankcase, and the partitions are formed integrally. The partition through portion is formed in a predetermined one of the partitions to connect an adjacent pair of the crank chambers, and opens toward the cylinders.

The present invention provides another cylinder block for an engine having a plurality of pistons and a crankshaft. The cylinder block includes a cylinder assembly, a block body, and a cylinder through portion. The cylinder assembly has a plurality of cylinders, each corresponding to one of the pistons. The block body has an outer wall accommodating the cylinder assembly, a crankcase accommodating the crankshaft, and a plurality of partitions. The partitions divide the space in the crankcase into a plurality of crank chambers. The number of the crank chambers corresponds to the number of the cylinders. The outer wall, the crankcase, and the partitions are formed integrally. The cylinder through portion is formed in the cylinder assembly. The cylinder through portion opens toward the block body and connects the interiors of an adjacent pair of the cylinders with each other.

Further, the present invention provides another cylinder block for an engine having a plurality of pistons and a crankshaft. The cylinder block includes a cylinder assembly, a block body, a partition through portion, and a cylinder through portion. The cylinder assembly has a plurality of cylinders, each corresponding to one of the pistons. The block body has an outer wall accommodating the cylinder assembly, a crankcase accommodating the crankshaft, and a plurality of partitions. The partitions divide the space in the crankcase into a plurality of crank chambers. The number of the crank chambers corresponds to the number of the cylinders. The outer wall, the crankcase, and the partitions are formed integrally. The partition through portion is formed in a predetermined one of the partitions to connect an adjacent pair of the crank chambers. The partition through portion opens toward the cylinders. The cylinder through portion is formed in the cylinder assembly. The cylinder through portion opens toward the block body and connects the interiors of an adjacent pair of the cylinders with each other.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

First Embodiment

A first embodiment of the present invention will now be described with reference to FIGS. 1 to 12. FIGS. 4, 6, 9, 10, 11, and 12 are cross-sectional views each taken along a plane perpendicular to the axis of a crankshaft 14.

In this embodiment, a cylinder block 11 according to the present invention is applied to an in-line four-cylinder engine 1.

<Structure of Engine>

Figure 1:
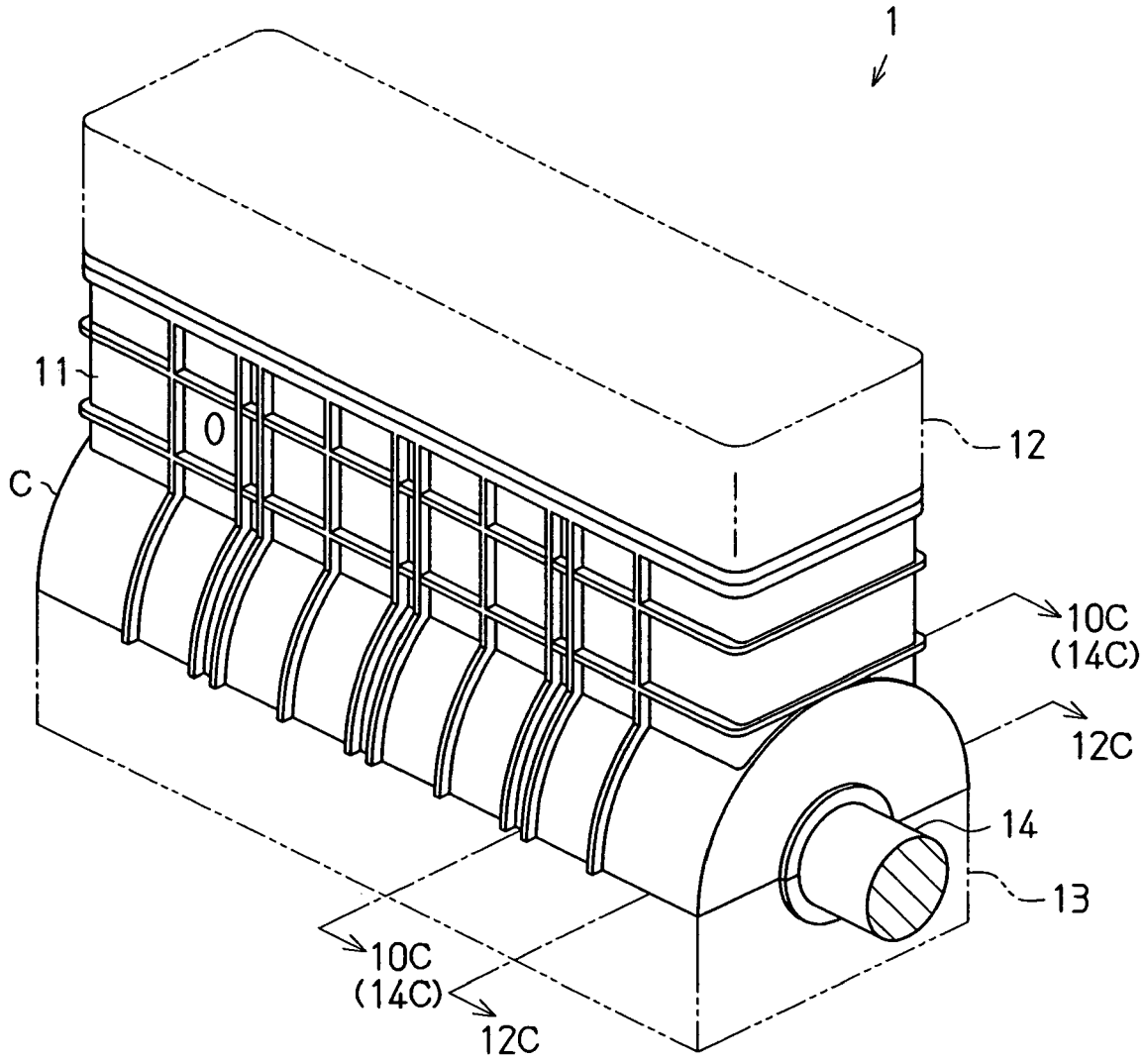
FIG. 1 is a perspective view illustrating an engine including a cylinder block according to a first embodiment of the present invention.

FIG. 1 illustrates the engine 1 that incorporates the cylinder block 11. The engine 1 includes the cylinder block 11, a cylinder head 12, an oil pan 13, and the crankshaft 14. The cylinder head 12 is attached to the top of the cylinder block 11.

The oil pan 13 is attached to the bottom of the cylinder block 11. The crankshaft 14 is located in a space in the cylinder block 11 that is defined by a crankcase C and the oil pan 13.

<Structure of Cylinder Block>

Figure 2:
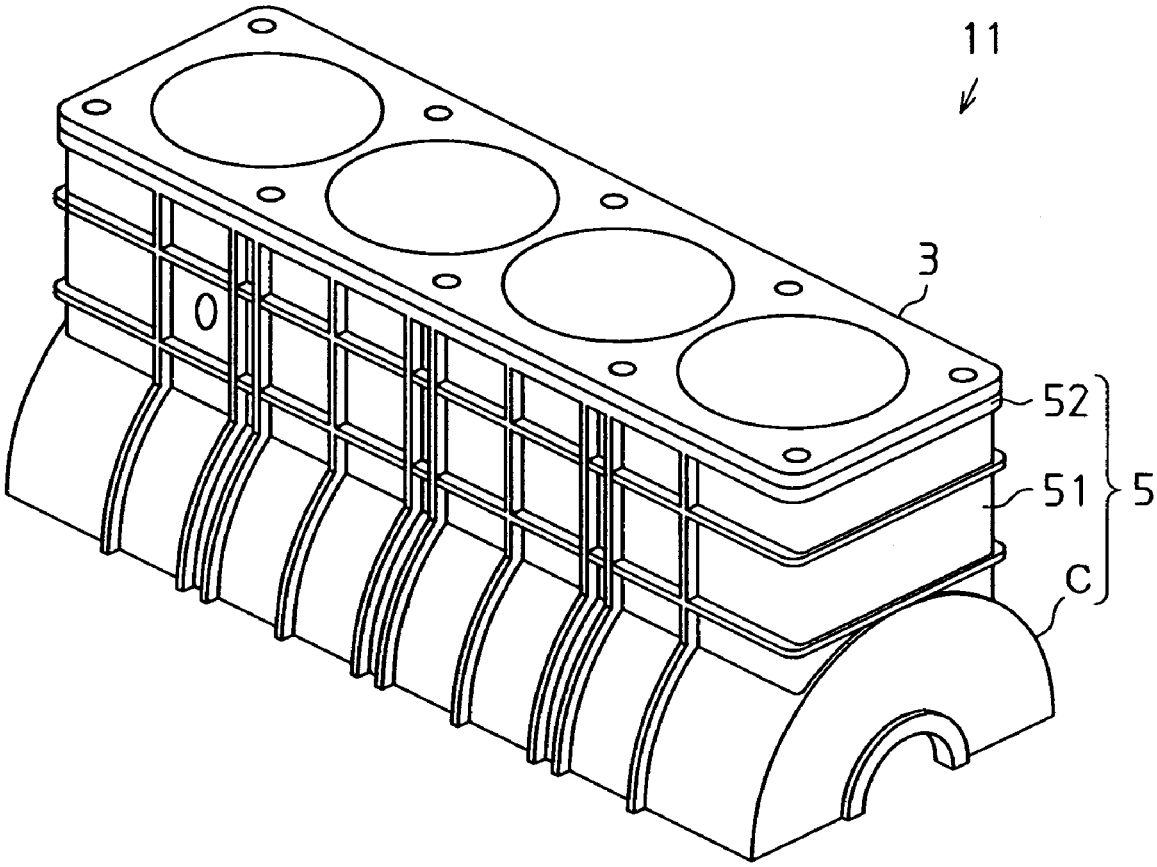
FIG. 2 is a perspective view illustrating the cylinder block shown in FIG. 1.

FIG. 2 illustrates the cylinder block 11. The cylinder block 11 includes a cylinder assembly 3 and a block body 5. The cylinder assembly 3 is formed to have in it cylinders 31. The block body 5 is formed to have in it a crankcase C and an outer wall 51.

The cylinder assembly 3 is assembled with the block body 5 by placing the cylinder assembly 3 on a body flange 52 formed in the outer wall 51 of the block body 5.

<Structure of Cylinder Assembly>

Figure 3:
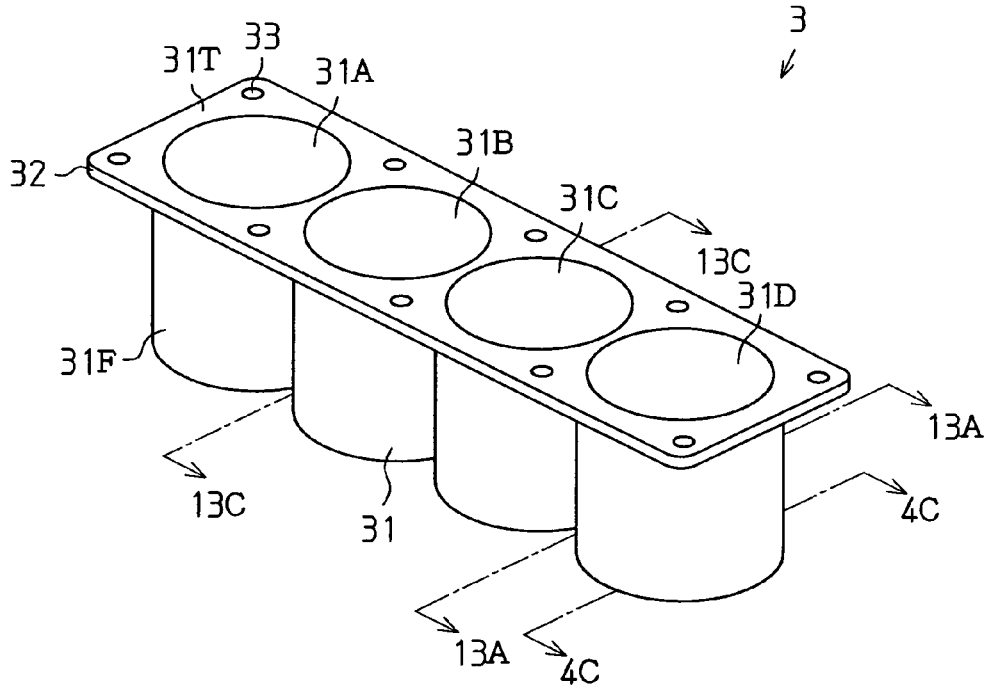
FIG. 3 is a perspective view illustrating a cylinder assembly that is part of the cylinder block shown in FIG. 1.
Figure 4:
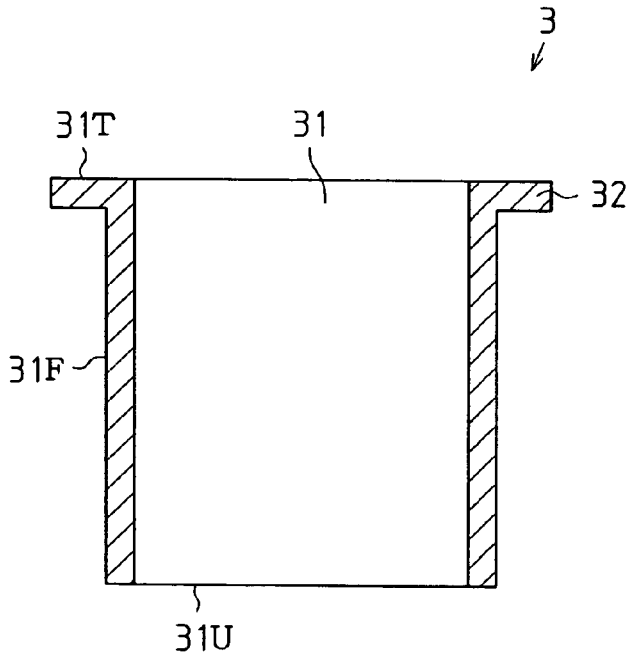
FIG. 4 is a cross-sectional view taken along line 4C—4C of FIG. 3.

FIGS. 3 and 4 show the cylinder assembly 3. The cylinder assembly 3 has the cylinders 31 (a first cylinder 31A, a second cylinder 31B, a third cylinder 31C, and a fourth cylinder 31D) and a cylinder flange 32. Each of the cylinders 31A, 31*b*, 31C, and 31D accommodates a piston of the engine. The cylinder flange 32 is formed to surround the upper end of the outer circumferential surface (a cylinder outer surface 31F) of the cylinders 31A, 31*b*, 31C, and 31D. The cylinder assembly 3 is formed integrally by casting.

In the engine 1 of the present embodiment, air-fuel mixture is ignited in the order of the first cylinder 31A, the third cylinder 31C, the fourth cylinder 31D, and then the second cylinder 31B.

According to the order of ignition, the crankshaft 14 sets the stroke positions of pistons in the cylinders (the position of each piston in the corresponding cylinder) in the following manner. That is, the stroke positions of the pistons in the first cylinder 31A and the fourth cylinder 31D are set equal to each other. Also, the stroke positions of the pistons in the second cylinder 31B and the third cylinder 31C are set equal to each other.

The cylinder head 12 of the engine 1 is placed on an end face of the cylinder flange 32 of the cylinder assembly 3, or on a cylinder deck surface 31T. An end face opposite to the cylinder deck surface 31T will be referred to as a cylinder bottom surface 31U.

Bolt holes 33 for receiving bolts are formed in the cylinder flange 32. The bolt holes 33 extend along the axes of the cylinders 31.

<Structure of Block Body>

Figure 5:
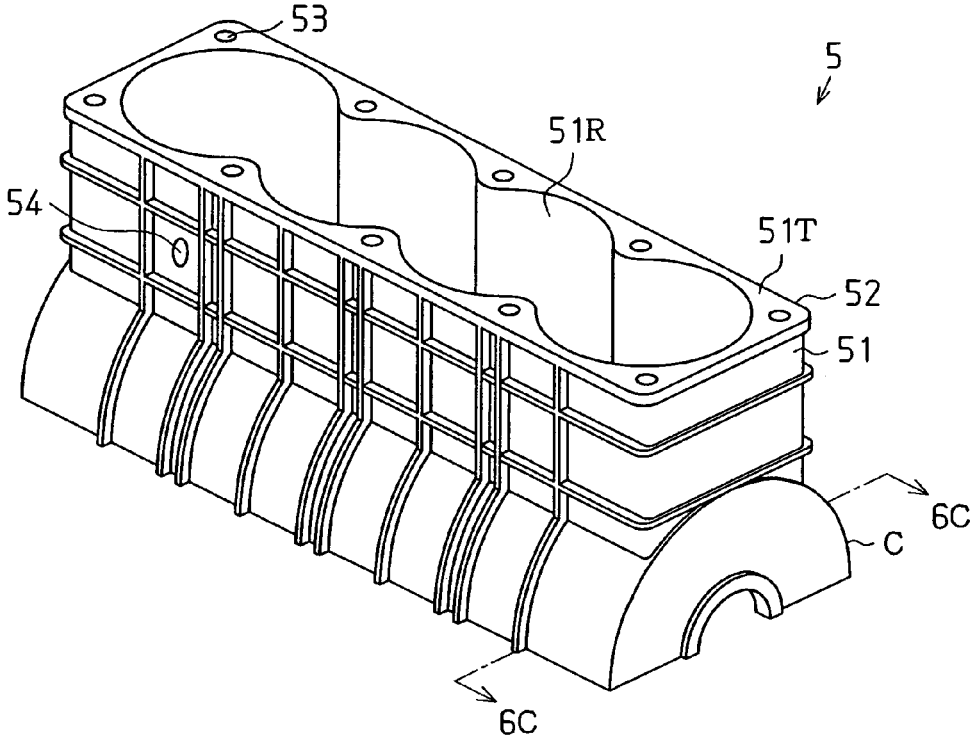
FIG. 5 is a perspective view illustrating a block that is part of the cylinder block shown in FIG. 1.
Figure 6:
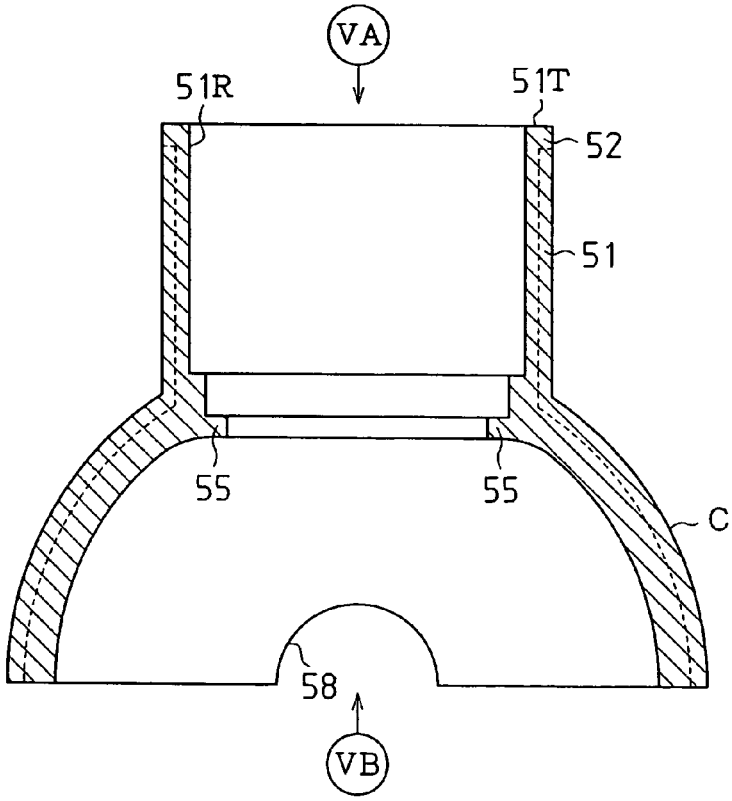
FIG. 6 is a cross-sectional view illustrating the block body taken along line 6C—6C of FIG. 5.

FIGS. 5 and 6 show the structure of the block body 5. The block body 5 includes the outer wall 51 for receiving the cylinder assembly 3, and the crank case C for receiving the crankshaft 14. The block body 5 is formed integrally by casting.

The inner surface of the outer wall 51 (outer wall inner surface 51R) is shaped to correspond to the cylinder outer surface 31F of the cylinder assembly 3. When the block body 5 and the cylinder assembly 3 are assembled, the outer wall inner surface 51R faces the cylinder outer surface 31F with a predetermined space in between. In the cylinder block 11, the space defined between the outer wall inner surface 51R and the cylinder outer surface 31F is used as a water jacket.

The outer wall 51 has a body flange 52, on which the cylinder flange 32 of the cylinder assembly 3 is placed. The top surface of the block body 5 (a block body deck surface 51T) contacts the cylinder flange 32 of the cylinder assembly 3.

Bolt holes 53 are formed in the outer wall 51 at positions that correspond to the bolt holes 33 of the cylinder assembly 3. The cylinder head 12 also has bolt holes (not shown) corresponding to the bolt holes 33, 53. Bolts are inserted in the sets of the bolt holes to assemble the cylinder block 11 and the cylinder head 12 to each other.

A coolant port 54 is formed in the outer wall 51 of the block body 5 to permit coolant to flow into or out of the water jacket. Inside the block body 5, a cylinder support 55 is formed at the boundary between the outer wall 51 and the crankcase C to support the cylinder assembly 3. The cylinder support 55 is formed along the entire perimeter of the inner surface of the block body 5.

<Internal Structure of Block Body>

Figure 7:
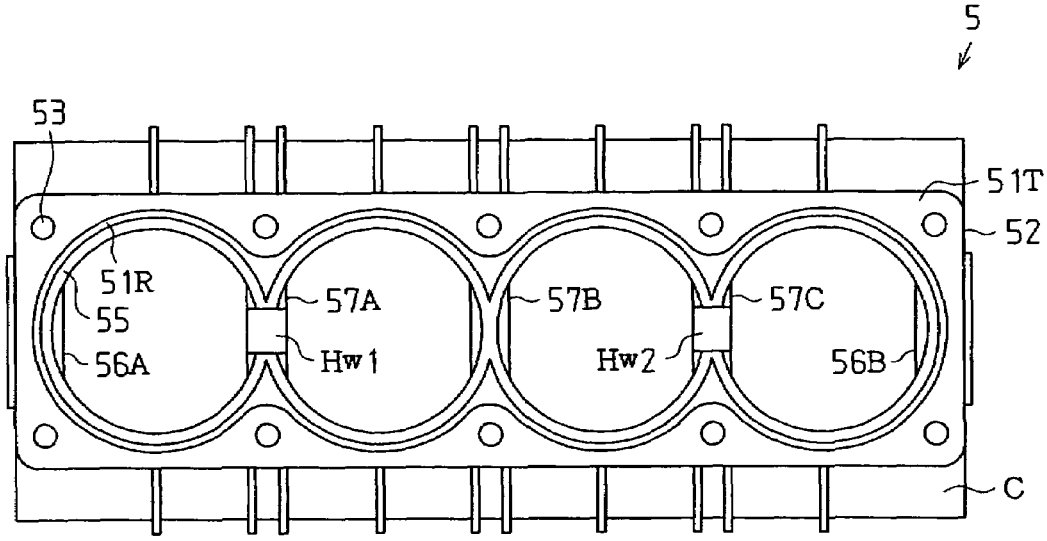
FIG. 7 is a plan view illustrating the block body as viewed in a direction of arrow VA in FIG. 6.
Figure 8:
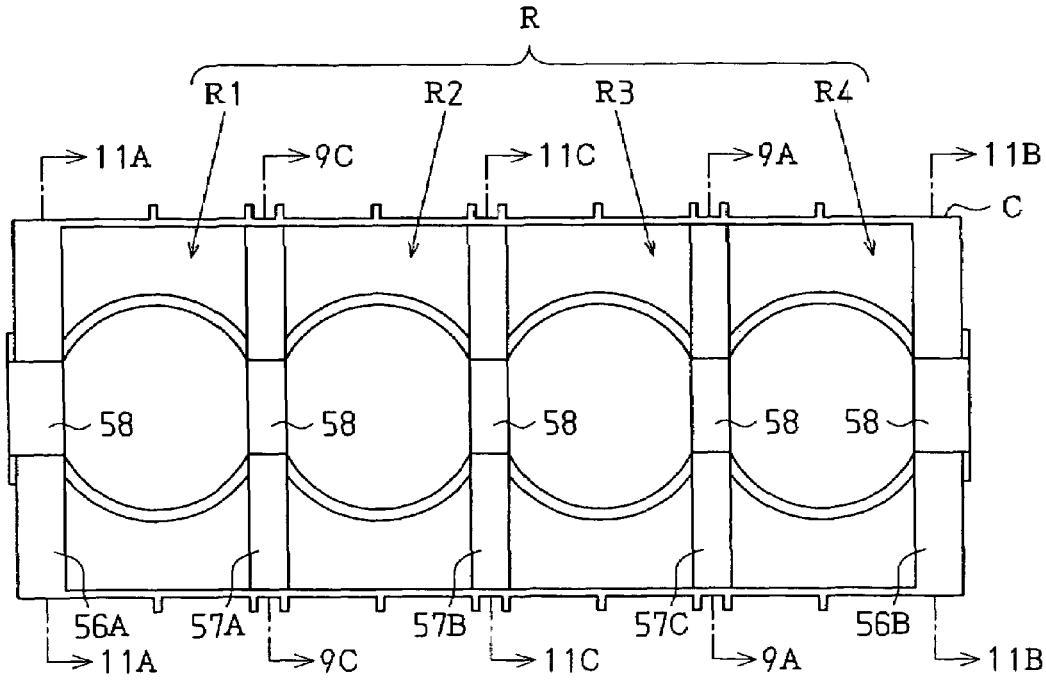
FIG. 8 is a plan view illustrating the block body as viewed in a direction of arrow VB in FIG. 6.

FIG. 7 is a plan view illustrating the block body 5 as viewed at the top surface (in a direction of arrow VA in FIG. 6). FIG. 8 is a plan view illustrating the block body 5 as viewed at the bottom surface (in a direction of arrow VB in FIG. 6).

In the crankcase C, a plurality of partitions (a first partition 57A, a second partition 57B, a third partition 57C) are provided between a side wall 56A and a side wall 56B. A bearing portion 58 for the crankshaft 14 is formed in each of the side walls 56A, 56B and the partitions 57A, 57B, 57C. The crankshaft 14 is installed in the block body 5 by supporting its journal at a crank cap from a direction facing the inner surfaces of the bearing portions 58.

A space R in the crankcase C is divided into a first crank chamber R1, a second crank chamber R2, a third crank chamber R3, and a fourth crank chamber R4 by the partitions 57A, 57B, and 57C.

The first crank chamber R1 is defined by the side wall 56A of the crankcase C and the first partition 57A. The first crank chamber R1 corresponds to the first cylinder 31A.

The second crank chamber R2 is defined by the first partition 57A and the second partition 57B. The second crank chamber R2 corresponds to the second cylinder 31B.

The third crank chamber R3 is defined by the second partition 57B and the third partition. 57C. The third crank chamber R3 corresponds to the third cylinder 31C.

The fourth crank chamber R4 is defined by the side wall 56B of the crankcase C and the third partition 57C. The fourth crank chamber R4 corresponds to the fourth cylinder 31D.

The first crank chamber R1 and the second crank chamber R2 are connected to each other by a first partition through portion Hw1. The first partition through portion Hw1 permits air to move from the first crank chamber R1 to the second crank chamber R2 and from the second crank chamber R2 to the first crank chamber R1.

The second crank chamber R3 and the fourth crank chamber R4 are connected to each other by a second partition through portion Hw2. The fourth partition through portion Hw2 permits air to move from the third crank chamber R3 to the fourth crank chamber R4 and from the fourth crank chamber R4 to the third crank chamber R3.

<Partition Having Through Portion>

Figure 9:
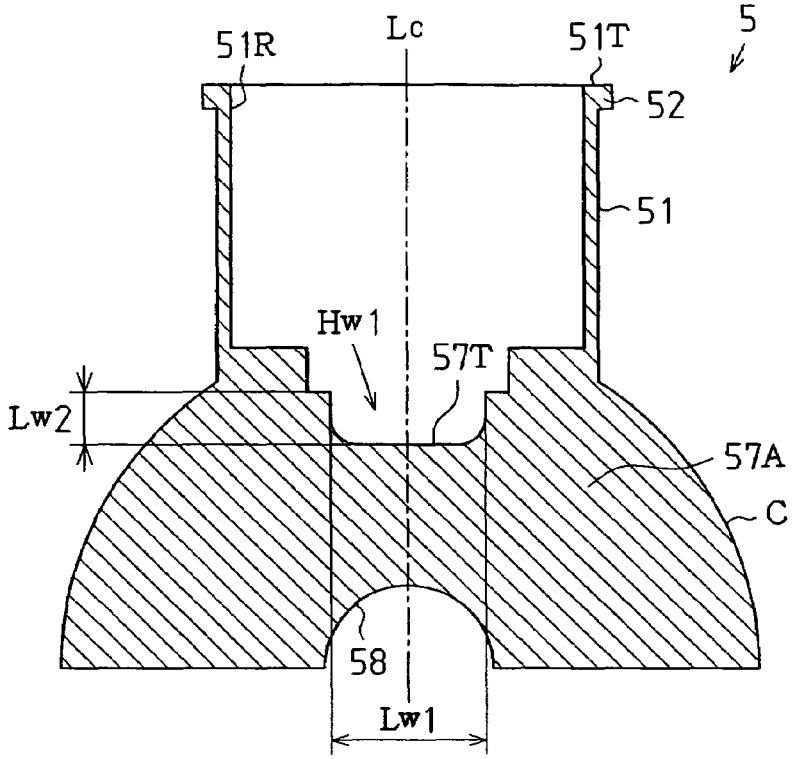
FIG. 9 is a cross-sectional view illustrating the block body taken along line 9C—9C of FIG. 8.
Figure 10:
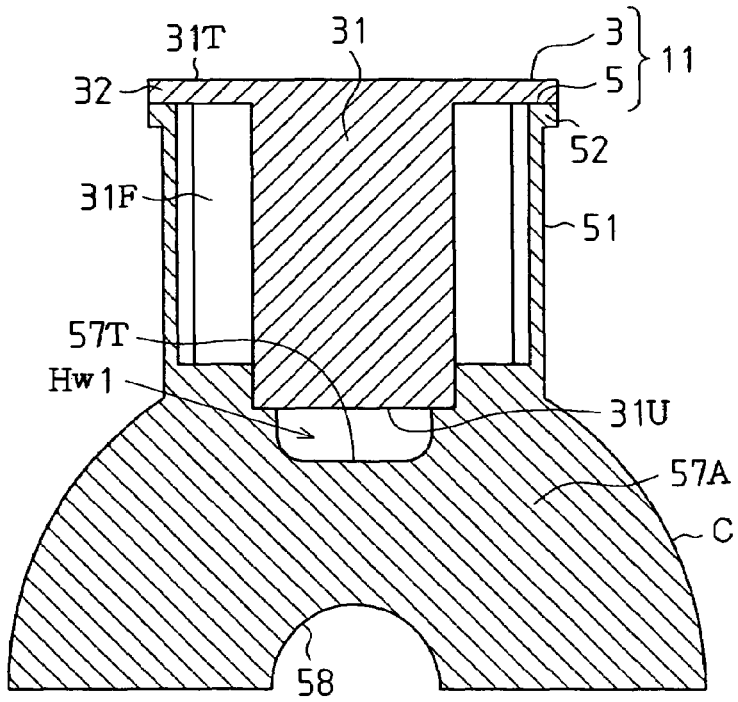
FIG. 10 is a cross-sectional view illustrating the cylinder block taken along line 10C—10C of FIG. 1.

FIG. 9 is a cross-sectional view of the block body 5. FIG. 10 is a cross-sectional view of the cylinder block 11.

The first partition through portion Hw1 is formed to have a concave shape at a top portion of the first partition 57A. That is, the first partition through portion Hw1 is formed in the first partition 57A as a recess open toward the body deck surface 51T.

When the cylinder assembly 3 is installed in the block body 5 as shown in FIG. 10, the first partition through portion Hw1 opens toward the cylinders 31. The cylinder bottom surface 31U and the top surface of the first partition 57A (partition top surface 57T) face each other with a predetermined space in between.

In a plane that is perpendicular to the axis of the crankshaft 14, the first partition through portion Hw1 is axially symmetric about the axis Lc of the corresponding cylinder 31.

The width Lw1 of the first partition through portion Hw1 (the length along a direction perpendicular to the axis Lc of the corresponding cylinder 31) is greater than the height Lw2 of the first partition through portion Hw1 (the depth of the recess along the axis of the corresponding cylinder 31). That is, the first partition through portion Hw1 is elongated along the direction perpendicular to the axis Lc of the corresponding cylinder 31. The shape of the first partition through portion Hw1 is optimized for avoiding interference with oil passages and bolt holes in the block body 5, while satisfying an inequality Lw1>Lw2.

The cross-section of the block body 5 taken along line 9A—9A of FIG. 8 is the same as the cross-section taken along line 9C—9C of FIG. 8, or as the cross-section shown in FIG. 9. That is, the second partition through portion Hw2 is formed in the third partition 57C in the same manner as the first partition through portion Hw1.

<Partition Having no Through Portion>

Figure 11:
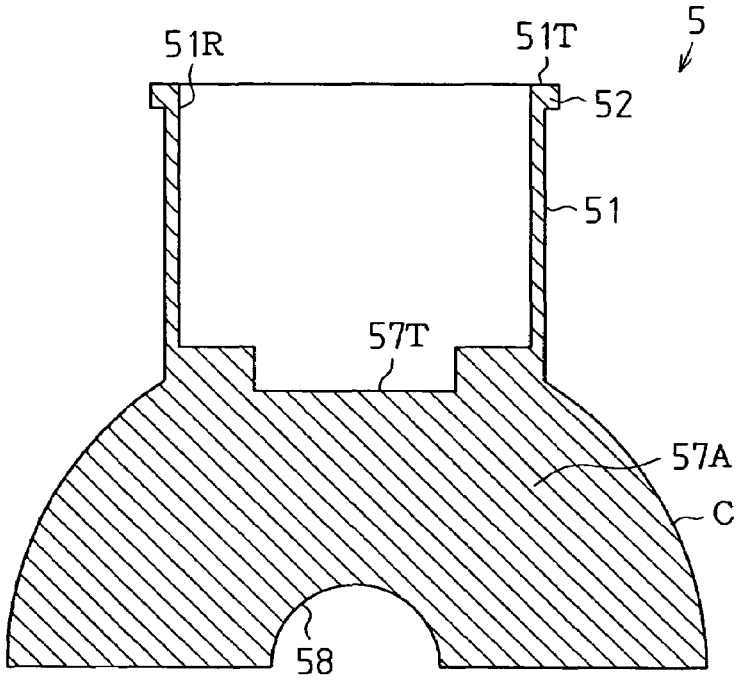
FIG. 11 is a cross-sectional view illustrating the block body taken along line 11C—11C of FIG. 8.
Figure 12:
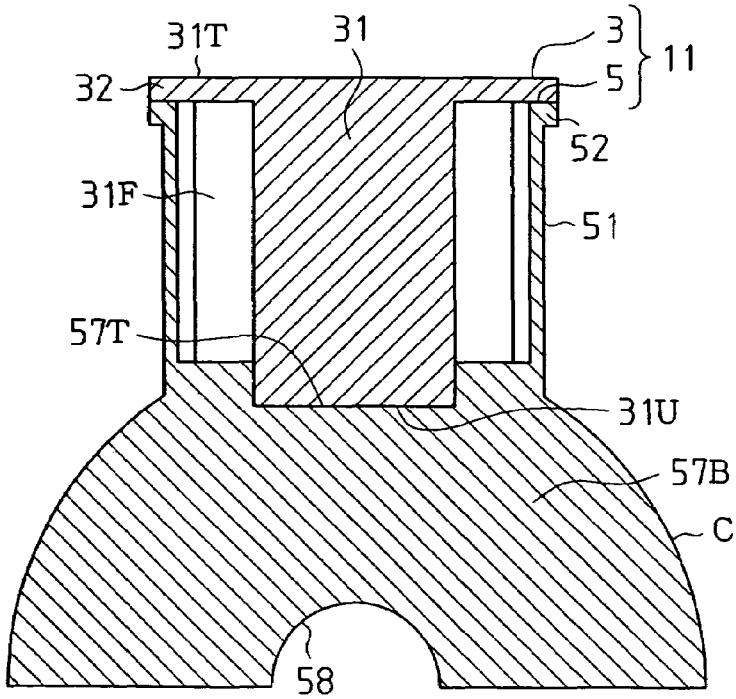
FIG. 12 is a cross-sectional view illustrating the cylinder block taken along line 12C—12C of FIG. 1.

FIG. 11 is a cross-sectional view showing the block body 5 taken along line 11C—11C of FIG. 8. FIG. 12 is a cross-sectional view showing the cylinder block 11 taken along line 12C—12C of FIG. 1.

The top surface of the second partition 57B (partition top surface 57T) is substantially smooth. That is, unlike the first partition 57A and the third partition 57C, the second partition 57B has no recess (through portion) for connecting the adjacent crank chambers with each other. Therefore, when cylinder assembly 3 is installed in the block body 5 as shown in FIG. 12, the cylinder bottom surface 31U contacts the top surface of the first partition 57A (the partition top surface 57T).

The cross-section taken along line 11A—11A and the cross-section taken along line 11B—11B of the block body 5 of FIG. 8 is the same as the cross-section taken along line 11C—11C of FIG. 8, or as the cross-section shown in FIG. 11. That is, like the second partition 57B, the side walls 56A, 56B has no recess (through portion) for connecting the adjacent crank chambers with each other.

<Advantages of Embodiment>

The cylinder block 11 according to the first embodiment provides the following advantages.

(1) In the first embodiment, the cylinder block 11 is formed of the separately prepared cylinder assembly 3 and the block body 5, and the partition through portions Hw1 and Hw2 are open to the cylinder.

Therefore, the shaping dies for the block body 5 can be formed to have portions corresponding to the partition through portions Hw1, Hw2. Unlike conventional cylinder blocks, no unnecessary through holes are formed.

Also, the partition through portions Hw1, Hw2 open toward the cylinder, that is, the partition through portions Hw1, Hw2 are formed in sections in the partitions that are closest to the cylinder. Therefore, when air in a crank chamber (including the interior of the corresponding cylinder connected to the crank chamber) is pushed by the piston, the pushed air is quickly discharged to an adjacent crank chamber.

Therefore, pumping loss caused by pressure fluctuation in the crank chamber is reduced.

By adopting the above configuration, the cylinder block 11 is provided that has a structure that eliminates the necessity of forming unnecessary through holes in the crankcase C, efficiently reduces pressure fluctuations in crank chamber R.

(2) Connecting adjacent crank chambers of a crank chamber with each other effectively reduces pumping loss. However, if the pistons of the cylinders corresponding to the connected crank chambers are set to have the same stroke positions, forming a through portion in the partition between the crank chambers does not reduce pressure fluctuation.

Accordingly, in the first embodiment, the second crank chamber R2 and the third crank chamber R3, which have the same piston stroke positions, are not connected to each other. Therefore, the rigidity of the cylinder block 11 is not reduced by forming unnecessary through portions.

(3) In the first embodiment, the through portions Hw1, Hw2 are formed in the topmost portions of the partitions 57A, 57C (portions closest to the cylinders 31). Therefore, when air in a crank chamber is pushed as the corresponding piston moves, air is conducted to an adjacent crank chamber before the inertia becomes greater. Pumping loss is therefore more efficiently reduced.

(4) In a cylinder block in which through holes are formed in partitions, stress is concentrated on an area about each through hole due to combustion pressure that acts on the crankshaft. If the concentrated stress is excessively increased, the partition may be damaged.

In this respect, the through portions Hw1, Hw2 are formed in the topmost portions of the partitions 57A, 57C in the first embodiment instead of forming through holes. Since this configuration extends the distance between each through portion Hw1, Hw2 and the crank journal, concentration of stress on the through portions Hw1, Hw2 is minimized.

(5) In the first embodiment, the width Lw1 of each through portion Hw1, Hw2 is greater than the height Lw2 of each through portion.

Therefore, when the through portions Hw1, Hw2 are formed to open toward the cylinders 31, air is more quickly moved from one crank chamber to an adjacent crank chamber compared to a case where the width Lw1 is less than the height Lw2. Therefore, pumping loss is more effectively reduced.

Adopting the configuration according to the first embodiment allows the limited space above the partitions to be effectively used, so that a structure of through portions suitable for reducing pumping loss is obtained.

(6) In the first embodiment, the first partition through portion Hw1 is axially symmetric about the axis Lc of the corresponding cylinder 31 in a plane that perpendicular to the axis of the crankshaft 14.

Therefore, when a piston causes air in the corresponding crank chamber to flow to an adjacent crank chamber, the flow of air is made uniform. Therefore, pumping loss is more efficiently reduced.

(7) In a conventional cylinder block, since through holes are formed by machining, residual stress may damage the cylinder block.

In this respect, the cylinder block 11 is formed by assembling the cylinder assembly 3 and the block body 5, and the block body 5 is formed to have the partition through portions Hw1, Hw2. Accordingly, no structure for through portions needs to be machined, which eliminates the occurrence of residual stress.

Second Embodiment

Figure 13:
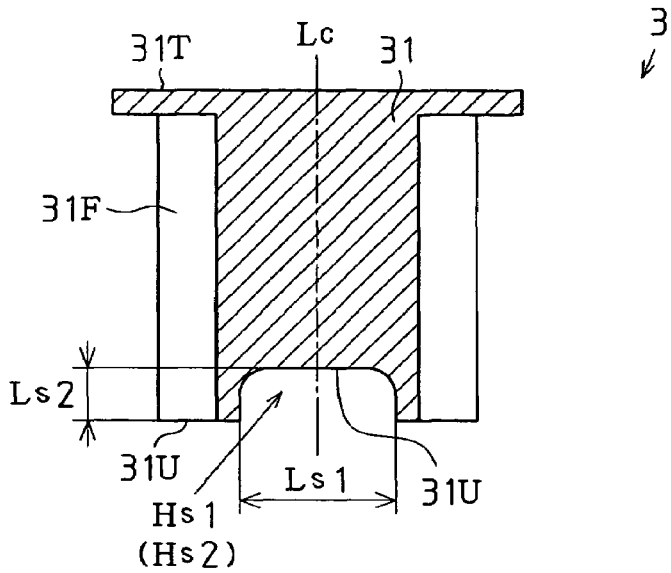
FIG. 13 is a cross-sectional view illustrating a cylinder block of an engine according to a second embodiment of the present invention taken along line 13C—13C of FIG. 3.
Figure 14:
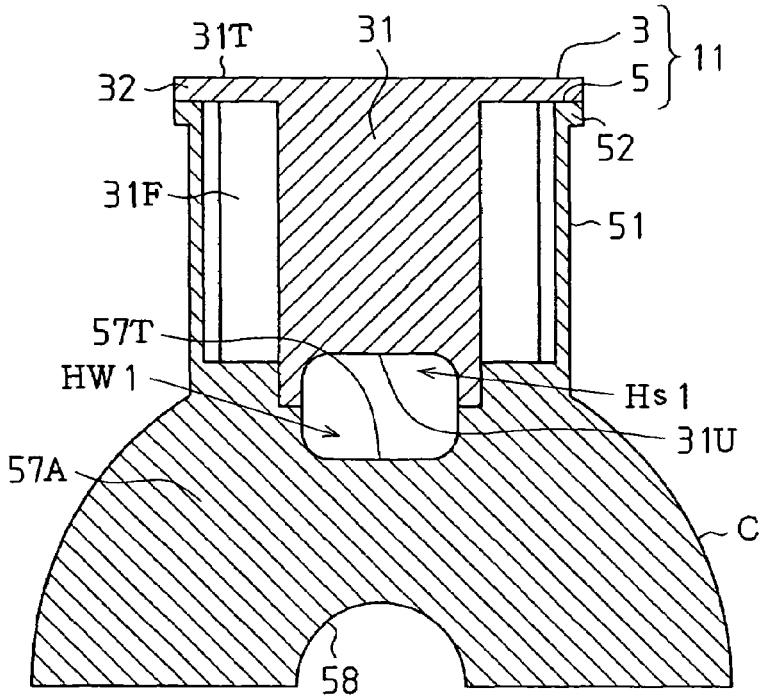
FIG. 14 is a cross-sectional view illustrating the cylinder block according to the second embodiment taken along line 14C—14C of FIG. 1.

A second embodiment of the present invention will now be described with reference to FIGS. 13 and 14. FIGS. 13 and 14 are cross-sectional views each taken along a plane perpendicular to the axis of a crankshaft.

A cylinder block of the second embodiment has the same structure as the cylinder block 11 of the first embodiment with the following modifications. Specifically, in the cylinder assembly 3, a through portion connecting an adjacent pair of the cylinders 31 is open to the cylinder bottom surface 31U.

<Shape of Through Portions>

FIG. 13 is a cross-sectional view showing a cylinder assembly 3 according to the second embodiment, which corresponds to a cross-section taken along line 13C—13C of FIG. 3. FIG. 14 is a cross-sectional view showing the cylinder block 11 according to the second embodiment, which corresponds to a cross-section taken along line 14C—14C of FIG. 1.

In the cylinder assembly 3, a cylinder through portion Hs is formed at a section where the circumferential wall of the first cylinder 31A is connected to the circumferential wall of the second cylinder 31B. The cylinder through portion Hs connects the interior of the first cylinder 31A and the interior of the second cylinder 31B with each other.

The cylinder through portion Hs is formed to have a concave shape at the bottom of the first cylinder 31A and the second cylinder 31B. That is, the cylinder through portion Hs is open to the cylinder bottom 31U.

When the cylinder assembly 3 is installed in the block body 5 as shown in FIG. 14, the cylinder through portion Hs1 opens toward the block body 5. The cylinder bottom surface 31U and the partition top surface 57T face each other with a predetermined space in between.

In a plane that is perpendicular to the axis of the crankshaft 14, the cylinder through portion Hs is axially symmetric about the axis Lc of the corresponding cylinder 31.

The width Ls1 of the cylinder through portion Hs1 (the length along a direction perpendicular to the axes Lc of the cylinders 31) is greater than the height Ls2 of the cylinder through portion Hs1 (the depth of the recess along the axes of the cylinders 31). That is, the cylinder through portion Hs is elongated along the direction perpendicular to the axes Lc of the cylinders 31.

The height Ls2 of the cylinder through portion Hs1 is set such that the cylinder through portion Hs1 does not interfere with a piston ring in a state where the volume of the corresponding combustion chamber is maximized.

The cross-section of the cylinder assembly 3 of this embodiment, which corresponds to the cross-section taken along line 13A—13A of FIG. 3, is the same as the cross-section shown in FIG. 13. That is, a cylinder through portion Hs2 is formed at a section where the circumferential wall of the third cylinder 31C is connected to the circumferential wall of the fourth cylinder 31D in the same manner as the first cylinder 31A and the second cylinder 31B.

<Operational Advantages>

In addition to the advantages listed in items (1) to (7) in the first embodiment, the cylinder block 11 of the second embodiment provides the following advantage.

(8) In addition to the partition through portions Hw1, Hw2, the cylinder through portions Hs1, Hs2 are formed in the cylinders 31 in this embodiment. This increases the amount of air that is discharged from one crank chamber to an adjacent crank chamber by the corresponding piston. Therefore, pumping loss is more effectively reduced.

It should be apparent to those skilled in the art that the present invention may be embodied in many other specific forms without departing from the spirit or scope of the invention. Particularly, it should be understood that the invention may be embodied in the following forms.

In the second embodiment, the partition through portions Hw1, Hw2 and the cylinder through portions Hs1, Hs2 are both formed. However, without forming the partition through portions Hw1, Hw2, only the cylinder through portions Hs1, Hs2 may be formed to reduce pumping loss.

In the second embodiment, the cylinder through portions Hs1, Hs2 are each substantially rectangular in a cross-section perpendicular to the axis of the crankshaft 14. However, the cylinder through portions Hs1, Hs2 may be formed to have other shapes. In short, as long as the width Ls1 of the cylinder through portion Hs is greater than the height Ls2 of the cylinder through portions Hs1, Hs2, the shape of the cylinder through portion Hs may be changed as necessary.

The above embodiments may be modified as follows.

In the illustrated embodiments, the partition through portions Hw1, Hw2 are each substantially rectangular in a cross-section perpendicular to the axis of the crankshaft 14. However, the partition through portions Hw1, Hw2 may be formed to have other shapes. In short, as long as the width Lw1 of the partition through portions Hw1, Hw2 is greater than the height Lw2-of the partition through portions Hw1, Hw2, the shape of the partition through portions Hw1, Hw2 may be changed as necessary.

In the illustrated embodiments, the present invention is applied to the cylinder block of an in-line four cylinder engine. However, the application of the present invention is not limited to the cylinder block of an in-line four cylinder engine. In short, the present invention may be applied to the cylinder block of any type of engine as long as it has a plurality of cylinders.

Therefore, the present examples and embodiments are to be considered as illustrative and not restrictive and the invention is not to be limited to the details given herein, but may be modified within the scope and equivalence of the appended claims.

The invention claimed:

1. A cylinder block for an engine having a plurality of pistons and a crankshaft, comprising:

a cylinder assembly having a plurality of cylinders, each corresponding to one of the pistons;

a block body that has an outer wall accommodating the cylinder assembly, a crankcase accommodating the crankshaft, and a plurality of partitions, the partitions dividing the space in the crankcase into a plurality of crank chambers, the number of the crank chambers corresponding to the number of the cylinders, wherein the outer wall, the crankcase, and the partitions are formed integrally; and a partition through portion formed as a recess open toward a body deck surface of the block body in a predetermined one of the partitions to connect an adjacent pair of the crank chambers.

2. The cylinder block for an engine according to claim 1, wherein the partition through portion is axially symmetric about the axis of the corresponding cylinder in a plane that is perpendicular to the axis of the crankshaft.

3. The cylinder block for an engine according to claim 1, wherein the stroke positions of the pistons in an adjacent pair of the cylinders are different from each other, and wherein the partition through portion is formed only in the partition located between the adjacent pair of the cylinders.

4. The cylinder block for an engine according to claim 1, the partition through portion is located on a cross-section perpendicular to the axis of the crankshaft, wherein, when a length of the partition through portion along a direction perpendicular to the axes of the cylinders is referred to as a width of the partition through portion, and a length of the partition through portion along the axes of the cylinders is referred to as a height of the partition through portion, the width of the partition through portion is greater than the height of the partition through portion.

5. A cylinder block for an engine having a plurality of pistons and a crankshaft, comprising:

a cylinder assembly having a plurality of cylinders, each corresponding to one of the pistons;

a block body that has an outer wall accommodating the cylinder assembly, a crankcase accommodating the crankshaft, and a plurality of partitions, the partitions dividing the space in the crankcase into a plurality of crank chambers, the number of the crank chambers corresponding to the number of the cylinders, wherein the outer wall, the crankcase, and the partitions are formed integrally; and a cylinder through portion formed as a recess in a bottom of a cylinder in the cylinder assembly, wherein the cylinder through portion opens toward the block body and connects the interiors of an adjacent pair of the cylinders with each other.

6. The cylinder block for an engine according to claim 5, wherein the cylinder through portion is axially symmetric about the axis of the corresponding cylinder in a plane that is perpendicular to the axis of the crankshaft.

7. The cylinder block for an engine according to claim 5, wherein the stroke positions of the pistons in an adjacent pair of the cylinders are different from each other, and wherein the cylinder through portion is formed only between the adjacent pair of the cylinders.

8. The cylinder block for an engine according to claim 5, wherein the cylinder through portion is located on a cross-section perpendicular to the axis of the crankshaft, wherein, when a length of the cylinder through portion along a direction perpendicular to the axes of the cylinders is referred to as a width of the cylinder through portion, and a length of the cylinder through portion along the axes of the cylinders is referred to as a height of the cylinder through portion, the width of the cylinder through portion is greater than the height of the cylinder through portion.

9. A cylinder block for an engine having a plurality of pistons and a crankshaft, comprising:

a cylinder assembly having a plurality of cylinders, each corresponding to one of the pistons;

a block body that has an outer wall accommodating the cylinder assembly, a crankcase accommodating the crankshaft, and a plurality of partitions, the partitions dividing the space in the crankcase into a plurality of crank chambers, the number of the crank chambers corresponding to the number of the cylinders, wherein the outer wall, the crankcase, and the partitions are formed integrally;

a partition through portion formed as a recess open toward a body deck surface of the block body in a predetermined one of the partitions to connect an adjacent pair of the crank chambers; and a cylinder through portion formed as a recess in a bottom of a cylinder in the cylinder assembly, wherein the cylinder through portion opens toward the block body and connects the interiors of an adjacent pair of the cylinders with each other.

10. The cylinder block for an engine according to claim 9, wherein the partition through portion is axially symmetric about the axis of the corresponding cylinder in a plane that is perpendicular to the axis of the crankshaft.

11. The cylinder block for an engine according to claim 9, wherein the stroke positions of the pistons in an adjacent pair of the cylinders are different from each other, and wherein the partition through portion is formed only in the partition located between the adjacent pair of the cylinders.

12. The cylinder block for an engine according to claim 9, wherein the cylinder through portion is axially symmetric about the axis of the corresponding cylinder in a plane that is perpendicular to the axis of the crankshaft.

13. The cylinder block for an engine according to claim 9, wherein the stroke positions of the pistons in an adjacent pair of the cylinders are different from each other, and wherein the cylinder through portion is formed only between the adjacent pair of the cylinders.

* * * * *

UNITED STATES PATENT AND TRADEMARK OFFICE

CERTIFICATE OF CORRECTION

PATENT NO. : 7,036,479 B2
APPLICATION NO. : 11/077075
DATED : May 2, 2006
INVENTOR(S) : Kazunari Takenaka et al.

It is certified that error appears in the above-identified patent and that said Letters Patent is hereby corrected as shown below:

| Column | Line | |
|---|---|---|
| 4 | 10 | Change "**31***b*" to --**31**B--. |
| 4 | 13 | Change "**31***b*" to --**31**B--. |
| 5 | 26 | After "partition" delete ".". |
| 6 | 60 | After "efficiently" insert --and--. |
| 7 | 39 | After "that" insert --is--. |
| 9 | 33 | Change "claimed" to --claims--. |
| 9 | 60 | After "claim **1**," insert --wherein--. |

Signed and Sealed this

Twentieth Day of November, 2007

JON W. DUDAS
*Director of the United States Patent and Trademark Office*